US007724225B2

(12) United States Patent
Yi

(10) Patent No.: US 7,724,225 B2
(45) Date of Patent: May 25, 2010

(54) DISPLAY PANEL FOR LIQUID CRYSTAL DISPLAY

(75) Inventor: Chien-Yu Yi, Gueishan Township, Taoyuan County (TW)

(73) Assignee: AU Optronics Corp., Hsinchu (TW)

( * ) Notice: Subject to any disclaimer, the term of this patent is extended or adjusted under 35 U.S.C. 154(b) by 1208 days.

(21) Appl. No.: 11/292,625

(22) Filed: Dec. 2, 2005

(65) Prior Publication Data

US 2006/0202935 A1 Sep. 14, 2006

(30) Foreign Application Priority Data

Mar. 8, 2005 (TW) ..... 94106951 A

(51) Int. Cl.
*G09G 3/36* (2006.01)

(52) U.S. Cl. ..... 345/89; 345/99; 345/100

(58) Field of Classification Search ..... 345/98, 345/99, 89

See application file for complete search history.

(56) References Cited

U.S. PATENT DOCUMENTS 5,805,121 A * 9/1998 Burgan et al. ..... 345/50
6,657,622 B2 * 12/2003 Park ..... 345/205
6,825,845 B2 * 11/2004 Nally ..... 345/545
2002/0008682 A1 1/2002 Park
2002/0084972 A1 * 7/2002 Kim ..... 345/99
2005/0001801 A1 * 1/2005 Kim ..... 345/89

OTHER PUBLICATIONS

China Office Action mailed Aug. 24, 2007.

* cited by examiner

*Primary Examiner*—Alexander Eisen
*Assistant Examiner*—Robin Mishler
(74) *Attorney, Agent, or Firm*—Thomas, Kayden, Horstemeyer & Risley

(57) ABSTRACT

A display panel for a liquid crystal display comprising a timing controller and a plurality of source drivers is provided. The timing controller receives a differential signal (LVDS/TMDS/DVI) to generate a plurality of TTL signals and a sync signal. Each of the source drivers comprises at least one bus directly connected to the timing controller to receive corresponding TTL signal. The timing controller comprises a clock line, coupled to the source drivers for transmission of the sync signal. Each TTL signal comprises a corresponding image information. The TTL signals, sequentially transmitted by the bus, conform to the transistor-to-transistor logic (TTL) standard.

6 Claims, 6 Drawing Sheets

| Resolution | Bit Width | Data CLK Freq.@60Hz | CD No. | Serial CLK Freq. |
|---|---|---|---|---|
| XGA | 6 | 65MHz | 8 | 24.375MHz |
| WXGA | 6 | 82MHz | 10 | 24.6MHz |
| SXGA | 6 | 108MHz | 10 | 32.4MHz |
| SXGA+ | 6 | 122MHz | 10 | 36.6MHz |

FIG. 5

DISPLAY PANEL FOR LIQUID CRYSTAL DISPLAY

BACKGROUND OF THE INVENTION

1. Field of the Invention

The invention relates to a liquid crystal display, and in particular, to a liquid crystal display circuit design.

2. Description of the Related Art

FIG. 1 shows a conventional display panel. The display panel comprises a timing controller (TCON) 102 for receiving differential signals like LVDS/TMDS/DVI, and two buses each coupled to a plurality of source drivers 104. For example, all of the odd source drivers 104 may couple to the one bus, while all the even source drivers 104 may couple to the other bus. Given a 6-bits gray level, a total of 18 transmission lines is required to deliver red, blue and green information from the TCON 102 to each source driver 104. Thus two buses utilize 36 transmission lines in total. If the gray level is 8 bits, 48 transmission lines are required. After the TCON 102 receives the LVDS/TMDS/DVI signals, the corresponding image information is transmitted to the source drivers 104 via the transmission lines. Signals on the transmission lines electrically conform to the TTL logic standard, and have a voltage of 3.3 V or 5V. The display panel also comprises a reference voltage generator 106, providing voltages based on gamma correction parameters.

FIG. 2 shows a conventional advanced display panel. The TCON 202 comprises a bus, both ends of which are equipped with terminators 208. All source drivers 204 simultaneously couple to the bus, thus the number of required transmission lines is reduced by half that of FIG. 1. Given a 6-bits gray level, the TCON 202 only requires 18 transmission lines to couple all source drivers 204. After the TCON 202 receives the LVDS/TMDS/DVI signals, image information is delivered to the source drivers 204 via the transmission lines, and signals on the transmission lines electrically conform to the reduced swing differential signal standard (RSDS). Similarly, the display panel also comprises a reference voltage generator 206, providing voltages based on gamma correction parameters.

FIG. 3 shows a conventional point-to-point display panel. The TCON 302 connects to each source driver 304 with individual transmission lines, and signals on the transmission lines conform to the point-to-point differential signal (PPDS) standard. The transmission lines are exclusive for each individual source driver 304, therefore the bus clock need not be shared, and the transmission rate can be significantly increased. Moreover, only a few transmission lines are required to deliver red, green, blue, and additional data. Similarly, the display panel also comprises a reference voltage generator 306, providing voltages based on gamma correction parameters.

Although PPDS reduces the number of transmission lines and the cost of PCBs, additional DC biased current is still required, thus, the power provided is inadequate for portable products. Additionally, with the progress of current technology, logic voltage requirement have been reduced from 5V to 1.8V/1.5V, making the implementation of differential signal will be more difficult.

BRIEF SUMMARY OF INVENTION

A detailed description is given in the following embodiments with reference to the accompanying drawings.

An exemplary embodiment of a display panel for a liquid crystal display circuit comprises a timing controller and a plurality of source drivers. The timing controller receives a LVDS/TMDS/DVI signal to generate a plurality of TTL signals and a sync signal. Each source driver comprises at least one bus directly connected to the timing controller for receiving a corresponding TTL signal. The timing controller comprises a clock line, coupled to the source drivers for transmission of the sync signal. Each TTL signal carries corresponding image information. The TTL signals, sequentially transmitted on the bus, conform to transistor-to-transistor logic (TTL) standard.

Each bus comprises three transmission lines that transmit a first TTL signal, a second TTL signal and a third TTL signal conforming to the TTL standard respectively. The first TTL signal, sequentially transmitted in one of the transmission lines, may carry red information. The second TTL signal, sequentially transmitted in another of the transmission lines, may carry green information. The third TTL signal, sequentially transmitted in the other of the transmission lines, may carry blue information.

A gamma reference table, coupled to the source drivers for providing gamma correction parameters, may be provided in the display panel. DC voltages of the first, second and third TTL signals are zero biased. The frequency of the first, second and third TTL signals is determined by the equation:

Frequency=(the clock of the timing controller×the number of the bit of the gray level)/(the number of the source drivers×2)

Each source driver may comprise two buses directly connected to the timing controller.

BRIEF DESCRIPTION OF DRAWINGS

The following detailed description, given by way of example and not intended to limit the invention solely to the embodiments described herein, will best be understood in conjunction with the accompanying drawings, in which:

FIG. 5 is a transmitted rate table respective to display resolution.

DETAILED DESCRIPTION OF INVENTION

A detailed description of the present invention is provided in the following.

Figure 1:
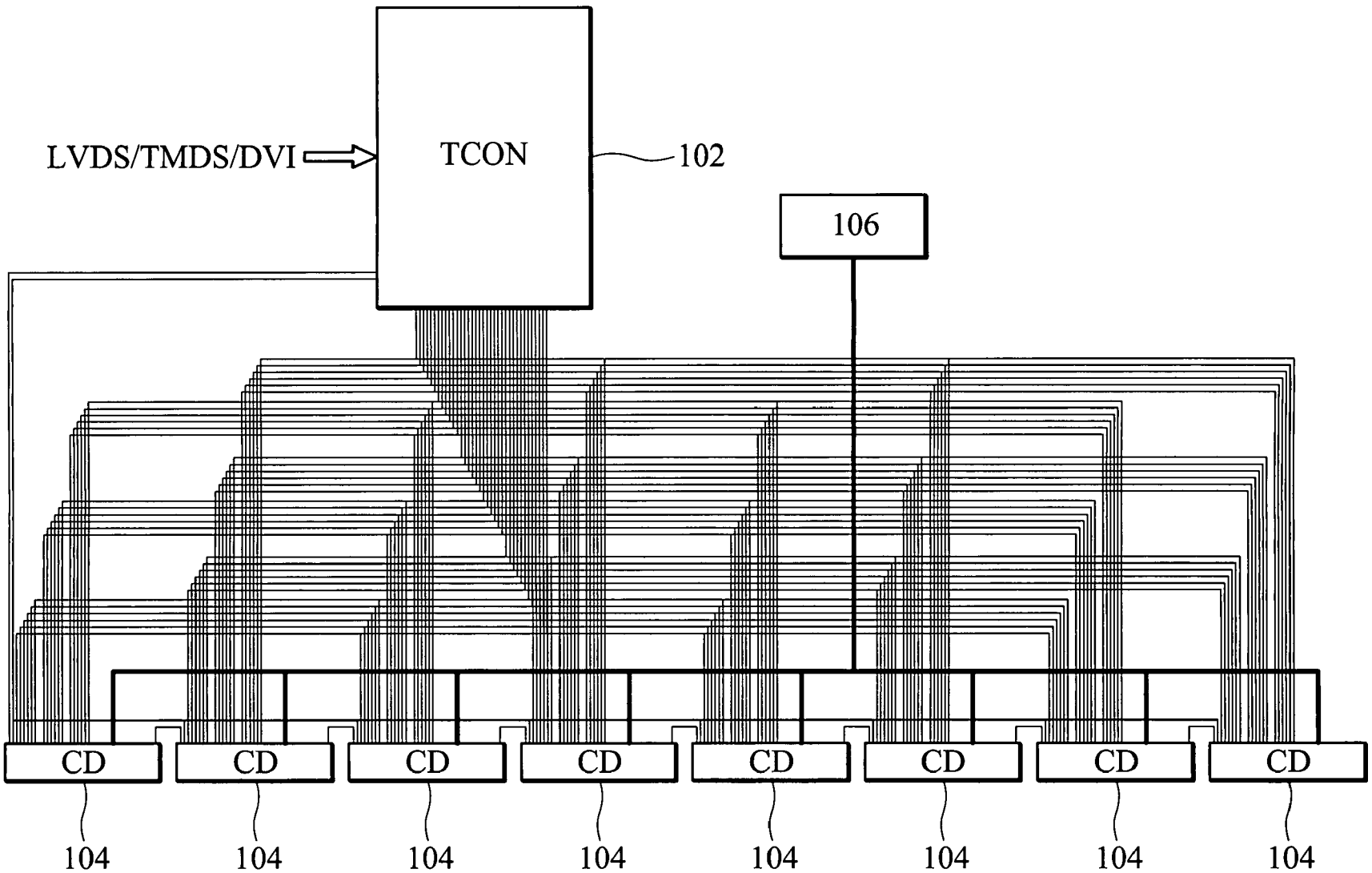
FIG. 1 (RELATED ART)
FIG. 1 shows a conventional display panel.
Figure 2:
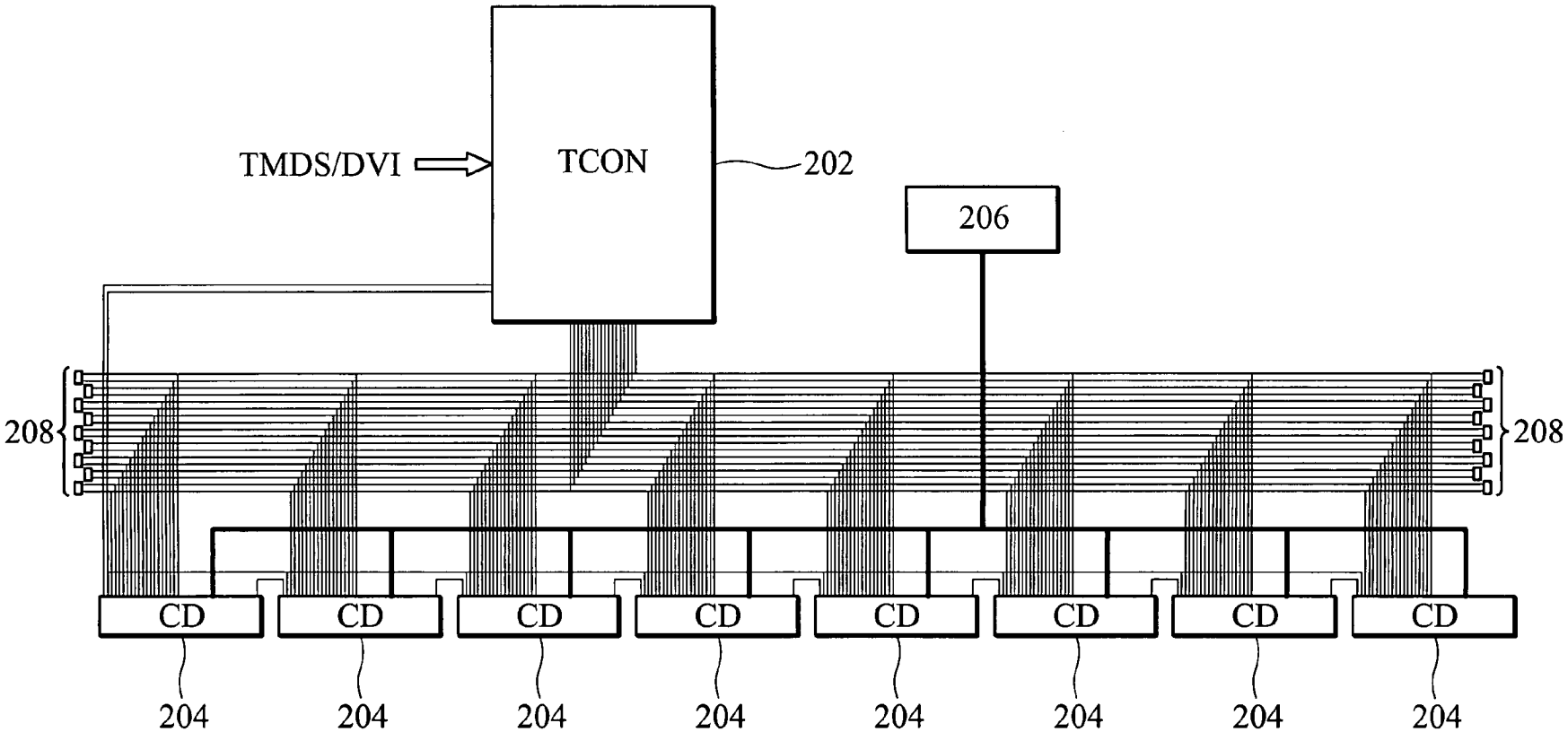
FIG. 2 (RELATED ART)
FIG. 2 shows a conventional advanced display panel.
Figure 3:
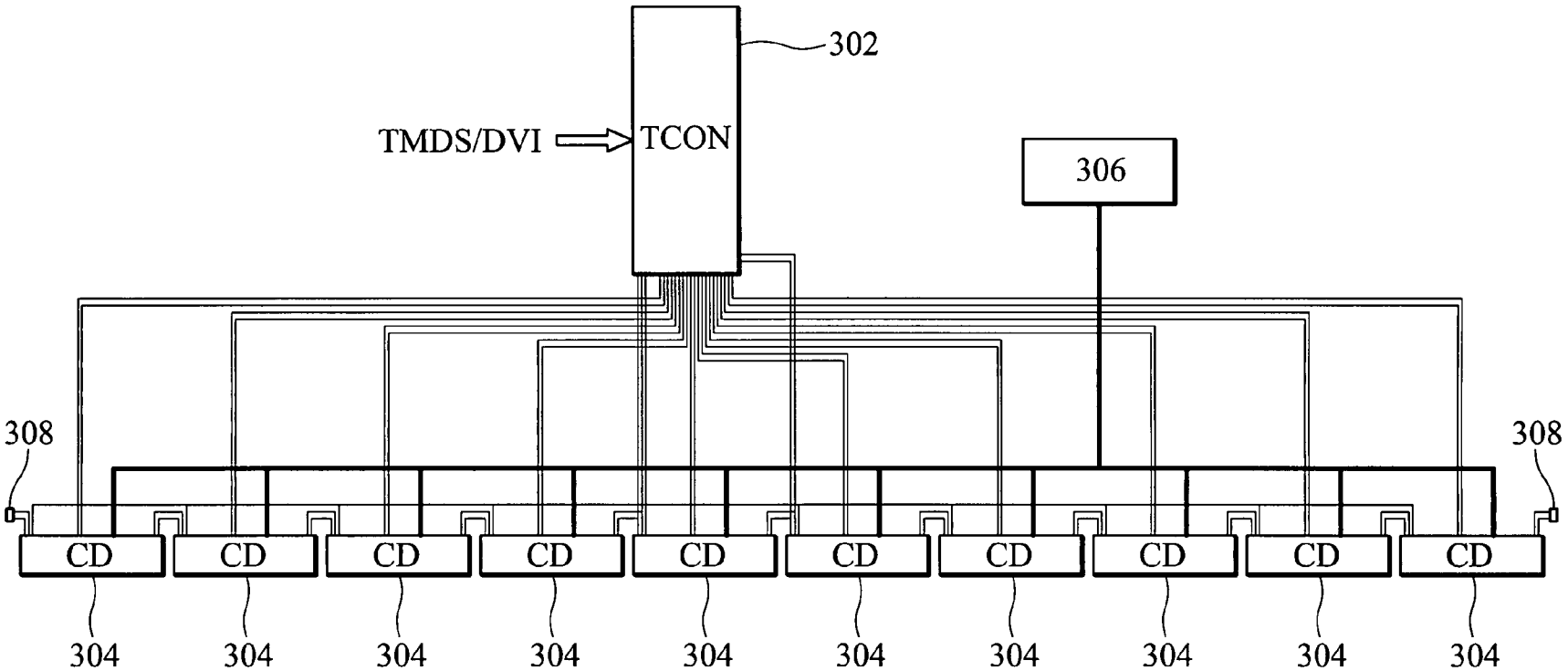
FIG. 3 (RELATED ART)
FIG. 3 shows a conventional point-to-point display panel.
Figure 4A:
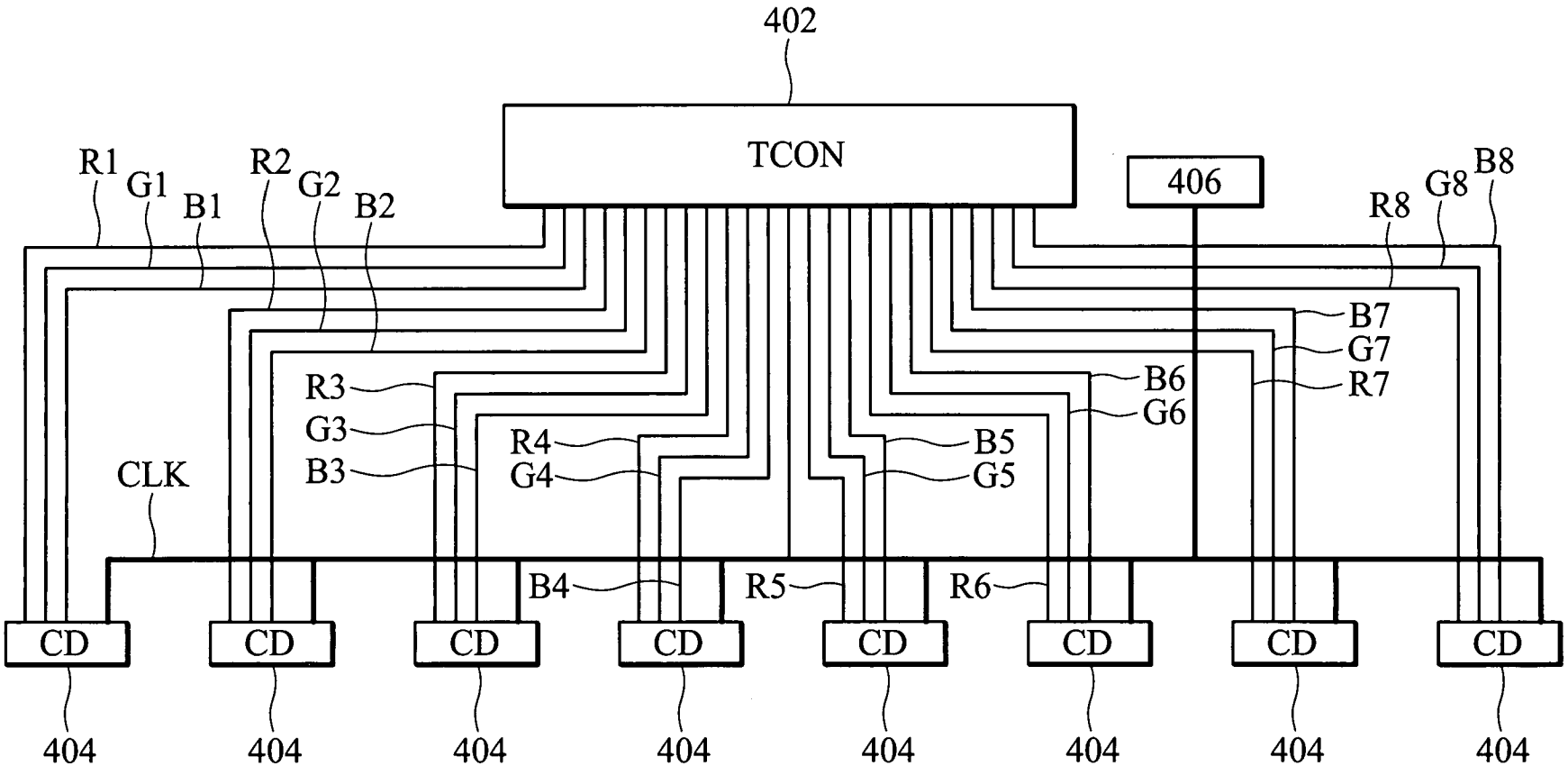
FIG. 4*a* shows an embodiment of the display panel according to the invention.

FIG. 4*a* shows an embodiment of the display panel according to the invention. Each source driver 404 is individually connected a TCON 402 via exclusive transmission lines, such as R1, G1, and B1 to R8, G8, and B8. Each transmission line exclusively delivers the information of red, green or blue. The TCON 402 also comprises a clock line CLK coupled to each source driver 404, providing a sync signal for sync control. The display panel also comprises a reference voltage generator 406 coupled to each source driver 404, providing gamma correction parameters. In this case, the TCON 402 utilizes a total of 24 transmission lines. The number of the transmission lines of the embodiment is more than the number of the transmission lines of the FIG. 2, however, the number of the bits of the gray level is not limited to 6 bits. The transmission lines Rx, Gx and Rx are not limited to delivering red, green and blue information. Specifically in this architecture, the reference voltage generator 406 can be eliminated, and the corresponding gamma correction parameters can be generated from the TCON 402 and delivered to the source drivers 404 via the transmission lines.

Figure 4B:
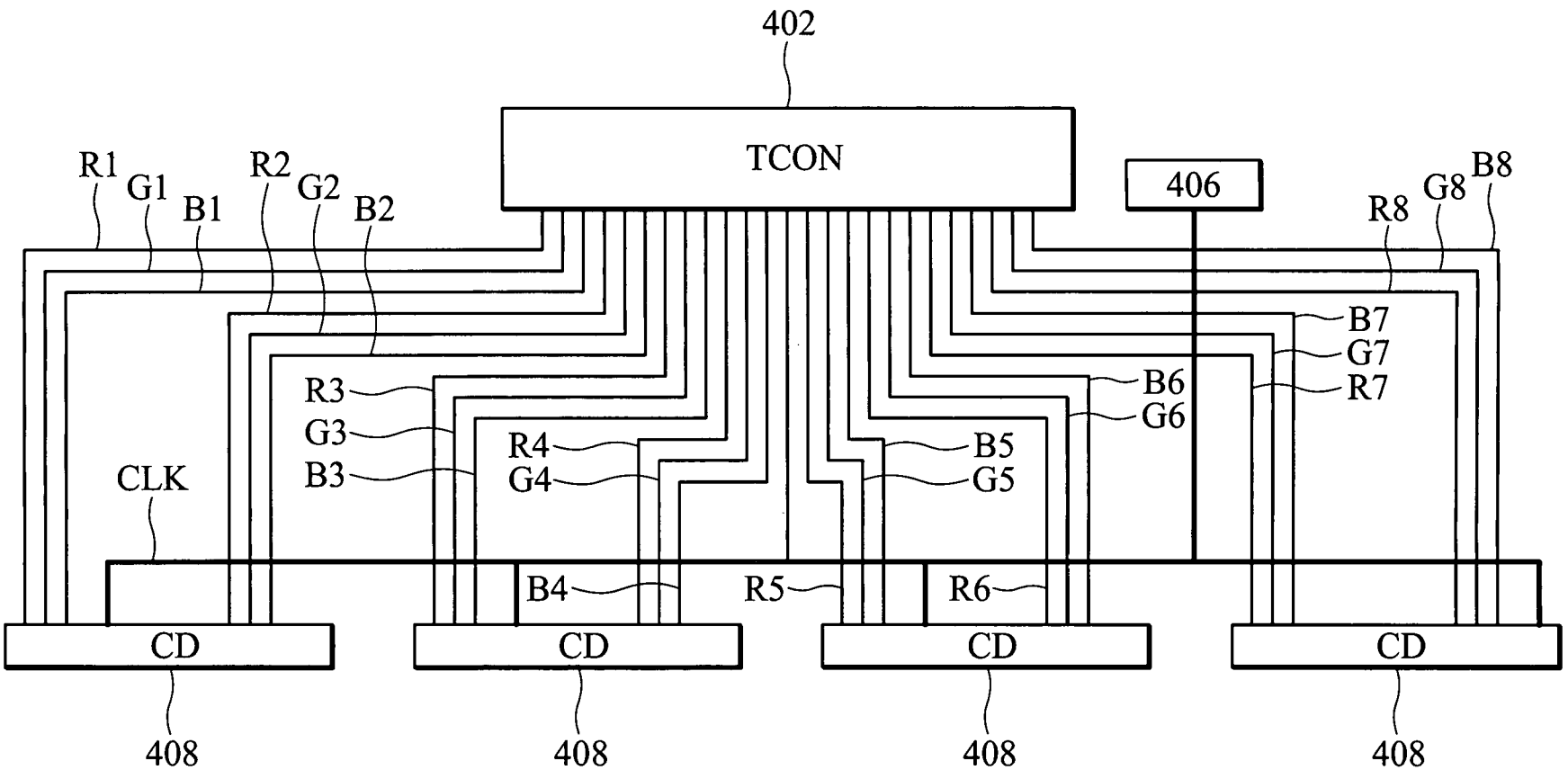
FIG. 4*b* shows another embodiment of the display panel according to the invention.

FIG. 4*b* shows another embodiment of the display panel according to the invention. The display panel comprises four source drivers 408, each comprises two set of RGB transmission lines coupled to the TCON 402. The source driver 408 is a merged version of the source driver 404 in FIG. 4*a*, therefore a total number of required source drivers is reduced.

FIG. 5 is a transmitted rate table of display resolution. Since the number of transmission lines each source driver replies on is fixed, the transmission rate is proportional to the data quantity. Typically, the clock rate of a TCON varies from screen resolution. For example, the TCON clock rate is 65 MHz under a 60Hz XGA mode, where 6 bits of gray level of red, green, or blue is given, and the source driver number is 8. Consider that both a rising edge and a falling edge of the TCON clock are effective triggers, therefore the transmission rate for each transmission line can be derived by the following equation to obtain 24.375 MHz:

Transmission rate=(the clock of the timing controller× the number of the bits of the gray level)/(the number of the Source drivers×2)

In summery, additional DC biased voltage is not required to utilize TTL logic signal, thus providing a significant advantage when implementing low voltage products such as a 1.8V system. The transmission lines are reduced while providing unlimited bits of gray level, and the power consumption is reduced.

While the invention has been described by way of example and in terms of the preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display panel for a liquid crystal display, comprising:

a timing controller, receiving a LVDS/TMDS/DVI differential signal, to generate a plurality of TTL signals and a sync signal; and a plurality of source drivers, each comprising at least one bus directly connected to the timing controller to receive the corresponding TTL signal; wherein:

the timing controller comprises a clock line, coupled to the source drivers for a transmission of the sync signal; and the TTL signals, sequentially transmitted in the bus, conform to the transistor-to-transistor logic standard;

wherein each bus comprises three transmission lines which transmit a first TTL signal, a second TTL signal or a third TTL signal respectively;

wherein the frequency of the first, second and third TTL signals is determined by the equation:

frequency=(the clock of the timing controller×the number of bits of a gray level)/(a number of the source driver×2).

2. The display panel as claimed in claim 1, wherein:

the first TTL signal, sequentially transmitted by one of the transmission lines, comprises red information;

the second TTL signal, sequentially transmitted by one of the transmission lines, comprises green information; and the third TTL signal, sequentially transmitted by one of the transmission lines, comprises blue information.

3. The display panel as claimed in claim 1, further comprising a gamma reference table, coupled to the source drivers to provide voltages based on gamma correction parameters.

4. The display panel as claimed in claim 1, wherein DC biased voltages of the first TTL signal, the second TTL signal and the third TTL signal are zero biased.

5. The display panel as claimed in claim 1, wherein each source driver comprises two buses directly connected to the timing controller.

6. The display panel as claimed in claim 1, wherein each bus in the plurality of source drivers is a dedicated connection to the timing controller pursuant to the point-to-point standard.

* * * * *